US008123205B2

(12) United States Patent
Martin

(10) Patent No.: US 8,123,205 B2
(45) **Date of Patent: *Feb. 28, 2012**

(54) UNIVERSAL LOCKING MECHANISM FOR A CLAMP

(75) Inventor: David Martin, Dearborn, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 80 days.

This patent is subject to a terminal disclaimer.

(21) Appl. No.: 11/714,311

(22) Filed: Mar. 6, 2007

(65) Prior Publication Data

US 2008/0217829 A1 Sep. 11, 2008

(51) Int. Cl.
*B25B 1/14* (2006.01)

(52) U.S. Cl. ..... 269/228; 269/201

(58) Field of Classification Search ..... 269/228, 269/79, 208–209, 238, 63, 67–71, 82–83, 269/201; 403/108, 84; 81/367–381, 315–320; 74/813 R, 532; 292/247, 256, 262, 282
See application file for complete search history.

(56) References Cited

U.S. PATENT DOCUMENTS

| | | | | |
|---|---|---|---|---|
| 368,273 | A * | 8/1887 | Berger et al. | 269/228 |
| 693,811 | A * | 2/1902 | Younge | 269/69 |
| 1,002,901 | A | 9/1911 | Christman | |
| 1,761,570 | A | 6/1930 | Komenak | |
| 1,907,432 | A | 5/1933 | Mears et at | |
| 1,915,492 | A | 6/1933 | Hennicke | |
| 2,386,567 | A * | 10/1945 | Olson | 269/228 |
| 2,984,176 | A | 5/1961 | Sommer et at | |
| 3,019,043 | A | 1/1962 | Woodworth et al. | |
| 3,297,348 | A | 1/1967 | Griffiths et al. | |
| 3,346,929 | A | 10/1967 | Webb | |
| 3,545,050 | A | 12/1970 | Blatt et al. | |
| 3,722,936 | A | 3/1973 | Stubert | |
| 3,885,932 | A | 5/1975 | Moore, Jr. et al. | |
| 3,888,528 | A | 6/1975 | Jericijo | |
| 3,924,844 | A * | 12/1975 | Bachtel, Jr. | 269/228 |
| 3,990,739 | A | 11/1976 | Head | |
| 4,017,281 | A | 4/1977 | Johnstone | |
| 4,141,543 | A * | 2/1979 | Kato | 269/228 |
| 4,155,586 | A | 5/1979 | Flynn | |
| 4,222,404 | A | 9/1980 | Flynn | |
| 4,538,951 | A | 9/1985 | Yeazel et al. | |
| 4,743,052 | A | 5/1988 | Stammreich et al. | |
| 4,762,345 | A | 8/1988 | Stluka et al. | |
| 5,165,148 | A | 11/1992 | Fleischer et al. | |
| 5,287,602 | A | 2/1994 | Dykstra | |
| 5,620,272 | A * | 4/1997 | Sheng | 403/96 |
| 5,967,502 | A | 10/1999 | Dykstra | |
| 6,386,598 | B1 | 5/2002 | Dykstra et al. | |
| 6,932,335 | B1 * | 8/2005 | Dykstra | 269/228 |
| 7,648,131 | B2 * | 1/2010 | Hagan et al. | 269/228 |
| 2005/0121843 | A1 | 6/2005 | Maffeis | |

* cited by examiner

FOREIGN PATENT DOCUMENTS

| | | |
|---|---|---|
| EP | 0 771 614 | 5/1997 |

*Primary Examiner* — Hadi Shakeri
(74) *Attorney, Agent, or Firm* — Harness, Dickey & Pierce, P.L.C.

(57) ABSTRACT

A manual locking clamp is disclosed. The manual locking clamp includes a base and a handle pivotally connected to the base. The manual locking clamp also includes a locking lever connected to the handle. The locking lever including a first locking orifice and a second locking orifice along with a fulcrum orifice and a pivot orifice. The locking lever is capable of being used on any known manual clamp, including pull action clamps, hold down action clamps, straight line action clamps, and any other known manual action clamps.

8 Claims, 3 Drawing Sheets

UNIVERSAL LOCKING MECHANISM FOR A CLAMP

BACKGROUND OF THE INVENTION

1. Field of the Invention

The present invention generally relates to locking clamps, and more particularly, relates to a manual universal locking mechanism for use on a variety of manual clamp mechanisms.

2. Description of Related Art

Manual clamps including pull action clamps and toggle locking action clamps have been known for numerous years. Many of these prior art toggle clamps may include a central handle housing, which has a pivoted latch element and leaf spring reacting against surfaces of the handle to preposition the latch for engaging a base mount latch pin upon actuating the clamp handle to a clamping position. Some of these prior art clamps are also simple to release by manual finger actuation of a lever. Some other prior art toggle clamps may use a locking means or mechanism that include a flat leaf spring lock welded to the handle that is released by a trigger member or the like.

Furthermore, many of these prior art over center toggle locking action clamps are ideally suited for holding against heavy forces such as those generated in plastic molding operations or the like. These clamps may also be ideal for quick clamping of doors, lids, access covers and drums, containers, other vessels or for holding work pieces to predetermined positions during manufacturing operations being performed thereon or the like. Some of these prior art clamps are equipped with a latch or bracket mechanism that engages a latch plate located on the door or the like. Furthermore, some of these prior art manual action clamps may use a plunger mechanism that will engage with a work piece or door for securing the work piece or door in a predetermined position. Furthermore, many of these manual action toggle clamps may be hold down clamps that hold a work piece or other component in a predetermined position during operation on the work piece or for holding the work piece in a predetermined position over a predetermined amount of time. Generally, many of these prior art toggle clamps require two hands to operate the manual clamps. In particular, to get the clamps into a locked position in the fully closed or clamped position. Furthermore, many of these different manual clamps, including hold down and pull action clamps, generally have to have a predetermined and specifically designed locking mechanism to lock the clamps in a closed or clamped position. Therefore, increased costs are required for designing a locking mechanism for each variety of clamp such as hold down clamps, pull action clamps, plunger clamps, and any other known manual operating clamp. Furthermore, many of these manual prior art clamps operate satisfactorily but are frequently subjected to environments of vibration, inverted positioning and other harsh industrial environments. Therefore, many of these prior art clamps require both of the users hands to open the clamp, i.e., one hand to either operate the clamp lever while the other is needed for pulling back the latch element on the clamp.

Hence, there is a need in the art for an improved manual action clamp, hold down clamp, plunging clamp, and any other type of manual clamp that is capable of one handed operation in the work environment while also providing for easy locking of the clamp in the fully closed or clamped position and in the fully opened position for each of the clamps. There also is a need in the prior art for an improved manual pull action, plunger, and hold down action clamp.

Furthermore, there is a need in the art for a universal locking mechanism that can be used on a hold down action clamp, pull action clamp or a plunger clamp without the need for redesign of the locking mechanism for each different type of manual action clamps.

SUMMARY OF THE INVENTION

One object of the present invention may be to provide an improved clamp.

Another object of the present invention may be to provide an improved one handed operating locking clamp.

Yet a further object of the present invention may be to provide a universal locking mechanism for use on manual action clamps.

Still a further object of the present invention may be to provide a universal locking mechanism for use on hold down action manual clamps, pull down action manual clamps, and plunging action manual clamps.

Still a further object of the present invention may be to provide a low cost and more economical to manufacture locking clamp.

Still another object of the present invention may be to provide a universal locking mechanism for a manual clamp that is capable of locking the clamp in both its fully closed and fully open position.

Still a further object of the present invention is to provide a more robust clamp that will be capable of locking via a squeeze lever.

To achieve the foregoing objects a manual locking clamp is disclosed. The clamp includes a base, and a handle pivotally connected to the base. The clamp also includes a locking lever connected to the handle wherein the locking lever having a first lock orifice and a fulcrum orifice therethrough. The locking lever may also include a second locking orifice and a predetermined bend therein. The locking lever is capable of locking the clamp in both its fully open and fully closed position.

One advantage of the present invention may be that it provides a clamp that is capable of one handed operation to lock the clamp in both its fully open or fully closed position.

A further advantage of the present invention may be that the clamp includes a universal locking mechanism that can be used with a variety of clamping systems such as but not limited to, pull actions clamps, hold down clamps, plunger clamps, etc.

Still another advantage of the present invention may be that the clamp is easier to manufacture and is more robust in holding a component or work piece in its fully clamped or closed position.

Still another advantage of the present invention may be that the clamp will include a locking lever that has a first lock orifice and a second lock orifice along with a fulcrum orifice.

Still a further advantage of the present invention may be to reduce the necessary time to move the hand clamp into either of the locking positions thus reducing manufacturing costs.

Yet another advantage of the present invention may be the ability to have the locking lever placed on either side of the manual clamp to better serve right or left handed users of the clamp.

Other objects, features and advantages of the present invention will become apparent from the subsequent description and the appended claims, taken in conjunction with the accompanying drawings.

DESCRIPTION OF THE EMBODIMENT(S)

Figure 1:
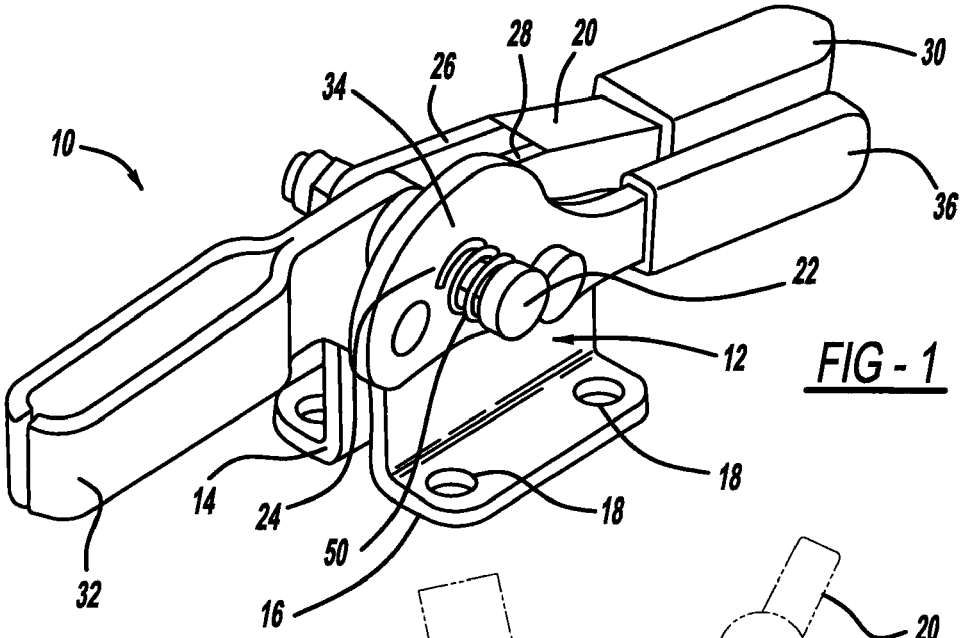
FIG. 1 shows a perspective view of a clamp according to the present invention.
Figure 2:
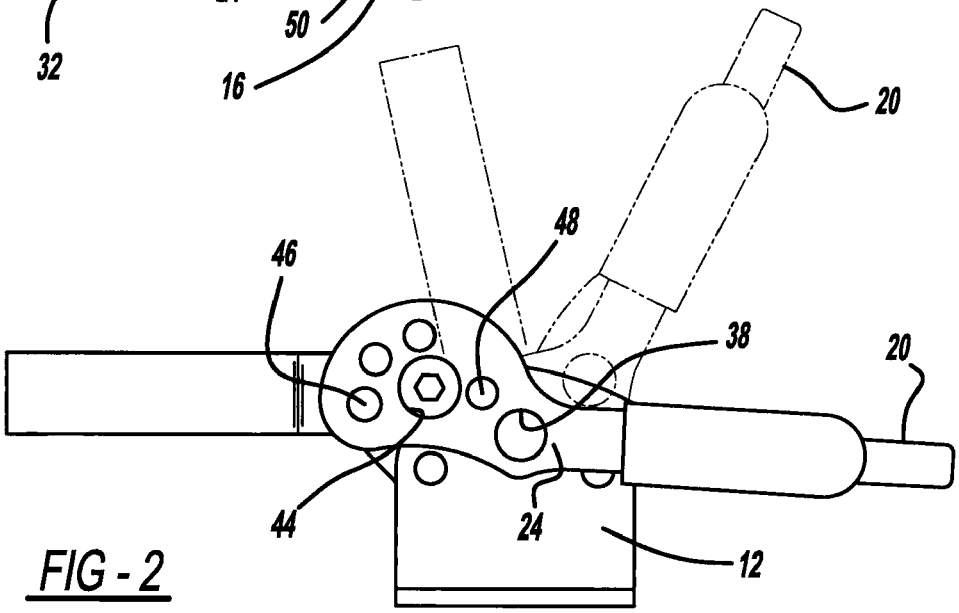
FIG. 2 shows a side view of a clamp according to the present invention in both the clamped and unclamped positions.
Figure 3:
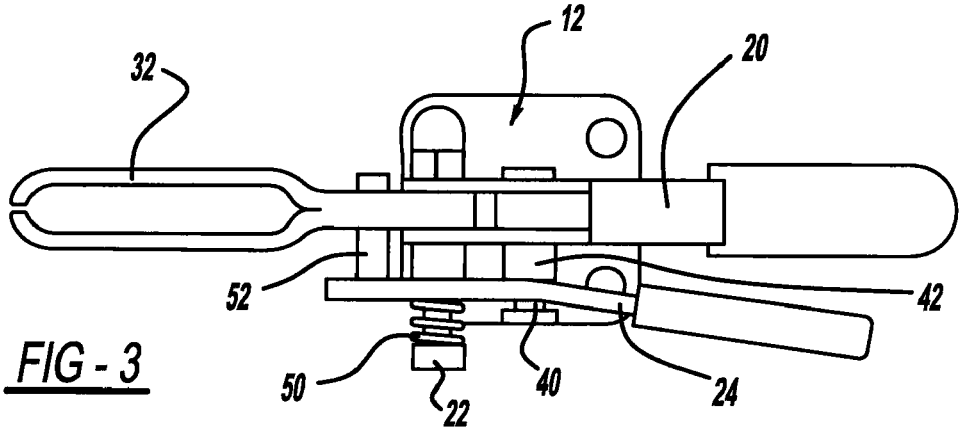
FIG. 3 shows a top view of a clamp according to the present invention.

Referring to the drawings, a clamp 10 according to the present invention is shown. It should be noted that the clamp 10 as shown in FIGS. 1 through 3 is a manual hold down toggle action locking clamp. However, any other type of manual clamp, such as pull action toggle clamp, straight line action clamps, latch action clamps, squeeze action clamps or plunger clamps, etc., may also be used in conjunction with the accompanying disclosed invention. It should also be noted that the present invention can be used on any known toggle action clamp or cam action clamp or any other known action clamp for a manual clamp mechanism.

As shown in FIGS. 1 through 3 the clamp 10 according to the present invention is in the form of a manual hold down action clamp. The clamp 10 includes a base 12, which in the embodiment shown, includes a first 14 and second base member 16 which are similar to each other. The base members 14, 16 include a plurality of orifices 18 therethrough. Some of the orifices 18 are used to connect the base 12 to a door, a wall, a table, or other component that is part of the clamping environment. Some of the other orifices 18 are used to connect a handle 20 thereto. The base 12 is generally made of a steel material, however any other type of metal, hard plastic, ceramic or composite may be used for the base 12 of the clamp 10. It should be noted that the base 12 may be made of a single piece of material and not have the first and second members 14, 16 as shown in the drawings. However, it is preferred to have a first and second member 14, 16 as shown in the drawings. The first and second members 14, 16 are arranged adjacent to one another to create the base 12 of the clamp 10. Each of the base members 14, 16 generally have an L-shape cross section. The upright portion of the base members 14, 16 may have any known shape that is compatible to the clamping environment in which the manual clamp 10 will be used. Generally, the base members 14, 16 are arranged back to back to one another, however, it should be noted that the base members 14, 16 may be welded together, have any other type of chemical or mechanical bond used to hold the base members 14, 16 together in a predetermined position to one another or may be separated by a spacer or other component.

A handle 20 is pivotally connected to the base 12 via an orifice 18 in the base 12 and an orifice in the handle 20. A fastener 22 is used to pivotally connect the handle 20 to the base 12. It should be noted that any known fastener 22 can be used to connect the handle 20 to the base 12, such as but not limited to a set screw with nut, pin, dowel, rod, or any other known type of fastener. The handle 20 will also include another plurality of orifices therethrough to connect to a locking lever 24 of the present invention. Furthermore, it should be noted that the handle 20 can be comprised of two separate pieces that are connected to each other via a fastener or via any mechanical or chemical bonding technique. The handle 20 is generally made of a steel material, however any other metal, plastic, hard ceramic, or composite may be used for the handle 20. The handle 20 may or may not include an outward extending portion to create interior space for passing of the base 12 therein. The handle 20 as shown in the present invention includes a solid one piece member with a first and second arm 26, 28 extending from an end thereof. The handle 20 may also include a handle grip 30 arranged on one end of the handle 20. The handle grip 30 can be made of any number of materials, such as rubber, plastic, composite, cloth, etc. The handle 20 will rotate in a pivoting manner with respect to the base 12 wherein the base 12 is fixed to a work machine or component.

A bar 32 is pivotally connected to the base 12 at a predetermined position thereof. The bar 32 in one embodiment shown is positioned pivotally on the fastener 22 that also pivotally connects one end of the handle 20 to the base 12. The bar 32 may have any known shape, however, the shape shown is a two piece end member that is capable of holding a hold down member therein. Arranged between the bar 32 and the handle 20 or between the handle 20 and base 12 may be a link. It should be noted that the bar 32 and link are all made of a steel material, however any other metal, hard plastic, ceramic, or composite may be used for these components.

A locking lever 24 is arranged adjacent to or may be in contact with the base 12 on one surface thereof. The locking lever 24 generally includes a body member 34 and an arm or finger 36 extending from the body 34 at a predetermined angle. The locking lever 24 generally will have a predetermined angled bend located at a predetermined position. Located at or near where the transition to the bend occurs is a fulcrum orifice 38. The fulcrum orifice 38 passes through the locking lever 24 and allows for the locking lever 24 to connect via any known fastener 40 to an orifice through the handle 20 of the clamp 10. It should be noted that in one contemplated embodiment a spacer 42 will be arranged between a surface of the handle 20 of the clamp 10 and a surface of the locking lever 24. The locking lever 24 also includes a pivot orifice 44 arranged through the body 34 of the locking lever 24. The pivot orifice 44 may be used to pivotally connect the locking lever 24 to the base member 12, bar 32 or handle 20. In one contemplated embodiment the base member 12 engages with a surface of the locking lever 34, however in another contemplated embodiment a spacer is arranged between the surface of the base member 12 and the surface of the locking lever 24. The fastener 22 placed through the pivot orifice 44 of the locking lever 24 is also the fastener that connects the handle 20 to the base member 12 and/or the bar 32. This will allow for the locking lever 24 to rotate in unison with the handle 20 about the base member 12. The locking lever 24 may also include a first lock orifice 46 and a second lock orifice 48 arranged at predetermined positions around the pivot orifice 44. The first lock orifice 46 will be used to clamp the clamp 10 in its fully closed or clamped position while the second lock orifice 48 will be used to clamp the clamp 10 in its fully open or unclamped position. It should be noted that the arm and body of the locking lever 24 can have any known shape. Arranged between the fastener 22 and a surface of the locking lever 24 is a spring member 50. The spring member 50 can be any known spring made of any known material and in the embodiment shown the spring 50 is made of a metal material, however any other composite, plastic, or like material may be used for the spring. The spring 50 will urge the locking lever 24 towards the base 12 of the clamp 10 in both the fully clamped position and fully unclamped positions. Generally, all of the orifices through the locking lever 24 will have a circular shape, however any other shaped orifice including but not limited to square, rectangular, oval, pentagonal, or any other random shape may be used for the orifices through the locking lever 24.

A locking pin 52 will be arranged through at least one surface of the base member 12, bar 32 or any other component of the clamp 10. The locking pin 52 will be used to engage with either the first locking orifice 46 or second locking orifice 48 depending on if the clamp 10 is in its fully clamped position or fully open position. It should be noted that the locking pin 52 generally is made of a steel material, however any other metal, ceramic, plastic, composite or the like may be used for the locking pin 52. It is contemplated to have the locking pin 52 extend through both members of the base 12 or bar 32 to ensure compatibility with either a left handed and right handed operator of the locking lever 24 depending on the user using the clamp 10. It should be noted that the predetermined angle or bend on the locking lever 24 will allow for a pivot mechanism having a fulcrum located generally at or near the bend in the locking lever 24 such that when the arm 36 of the locking lever 24 is pressed towards the handle 20, the locking lever 24 will disengage from the locking pin 52 and allow for rotation of the manual clamp 10 either into a fully clamped position or into a fully unclamped position. Thus, allowing the operator of the clamp to ensure that the clamp is positively locked in either a fully clamped or fully unclamped position due to engagement of the locking pin 52 with either the first lock orifice 46 or second lock orifice 48 depending on the design requirements. The universal locking lever 24 is capable of being used on a variety of clamps as shown in FIGS. 1 through 9. It can be used on any known manual locking clamp such as straight line action clamps, plunger clamps, hold down action clamps, pull action clamps, latch clamps, or any other known manual or power locking clamp. It should also be noted that the size and shape of the locking lever 24 can be changed and it is also contemplated to have just one locking orifice through the body of the locking lever 24 to ensure that the clamp 10 is always in its fully clamped or closed position. However, generally a first and second locking orifice 46, 48 will be used to ensure that the clamp 10 is positively locked in its fully closed or clamped position or fully opened or unclamped position. Furthermore, it is also contemplated that the lever 24 will have a predetermined member of locking orifices 46, 48 greater than the two disclosed in the one contemplated embodiment. This plurality of orifices 46 may be arranged in any type of pattern through the locking lever 24. The use of a plurality of locking orifices will allow for the clamp 10 to be locked in any member of intermediate positions as well as the fully opened and closed. The plurality of locking orifices 46, 48 can be used on any of the clamps or design disclosed or contemplated herein. It should also be noted that the locking lever 24 and associated plurality of orifices 46, 48 may lock on a locking pin 52 or it is even contemplated to have one orifice that locks on a plurality of pins or a plurality of orifices that lock on a plurality of pins.

Figure 4:
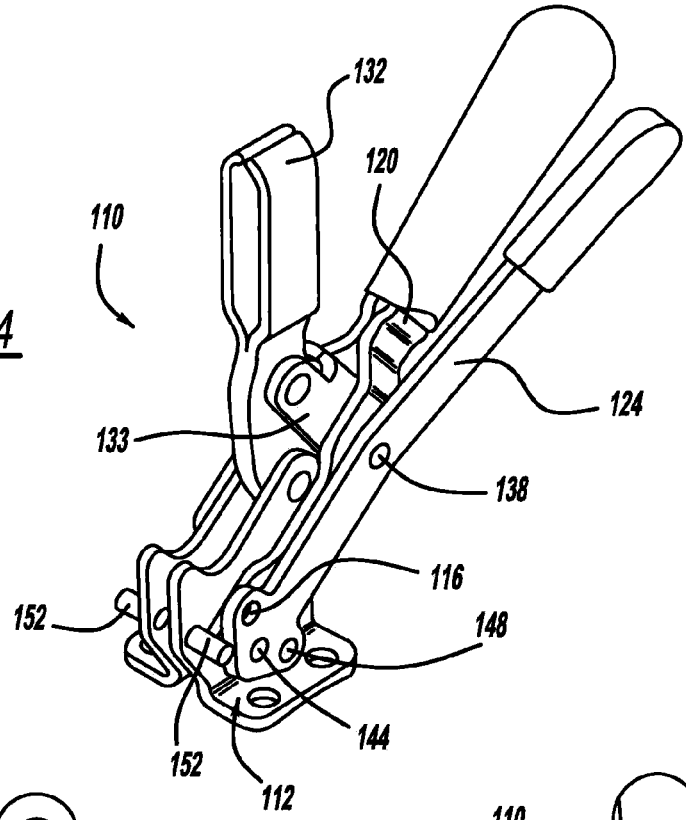
FIG. 4 shows an alternate embodiment of a clamp according to the present invention in perspective view.
Figure 5:
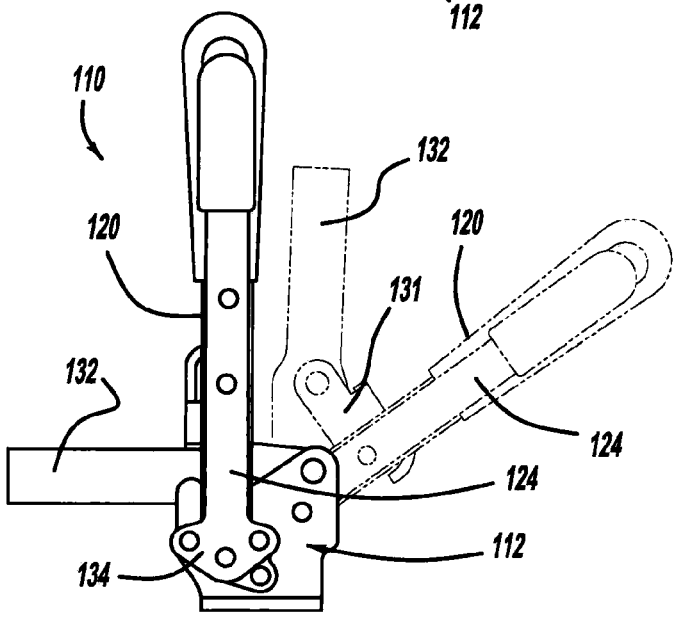
FIG. 5 shows a side view of an alternate embodiment of a clamp according to the present invention in both its clamped and unclamped positions.
Figure 6:
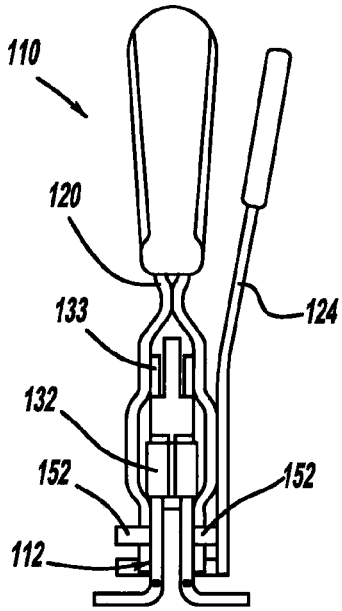
FIG. 6 shows an end view of an alternate embodiment of a clamp according to the present invention.

FIGS. 4 through 6 show an alternate embodiment of a clamp 110 according to the present invention. Like numerals represent like parts. In particular, it shows a hold down action manual clamp 110. The hold down manual action clamp 110 generally has the same parts as that of the clamp 10 shown in FIGS. 1 through 3. A base 112 member has a handle 120 pivotally connected thereto and a bar member 132 is pivotally connected to the base member 112 at a predetermined point. A link member 133 is pivotally connected between the bar member 132 and the handle member 120. A locking member 124 similar to but not exactly like that for FIGS. 1 through 3 is then connected at a fulcrum orifice 138 to the handle member 120 at a predetermined position thereof. The locking lever 124 is also connected to the base member 112 via a pivot orifice 144 through the locking lever 124 which will allow for the locking lever 124 to hold the clamp 110 in both its fully opened or fully closed positions via a first locking orifice 146 and second locking orifice 148 arranged through the locking lever 124 of the hold down clamp 101 as shown in FIGS. 4 through 6. The locking lever 124 will operate generally in the same manner as that described above for FIGS. 1 through 3 in that the locking lever 124 will be squeezed and urged towards the handle 120 thus creating a pivot member that has a fulcrum point connected to the handle 120 which will release the body 134 of the locking lever 124 from the locking pin 152 arranged within the base member 112 of the hold down action clamp 110. The operator of the hold down action clamp 110 can lock the clamp 110 in either its fully closed position or fully opened position via rotation of the locking lever 124 with relation to the base 112 and hence locking pin 152 arranged therein.

Figure 7:
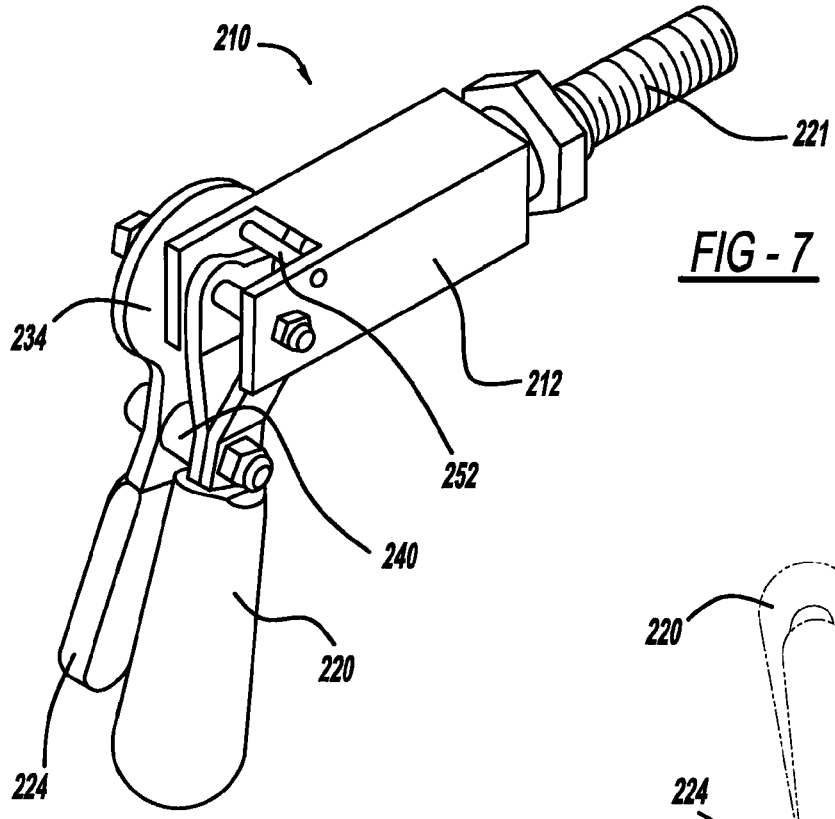
FIG. 7 shows an alternate embodiment of a clamp according to the present invention.
Figure 8:
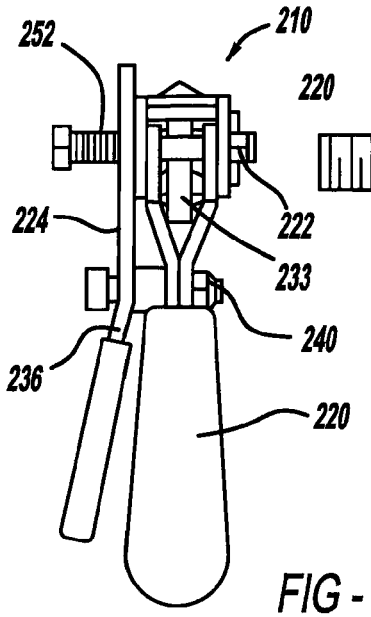
FIG. 8 shows an end view of a clamp according to an alternate embodiment of the present invention.
Figure 9:
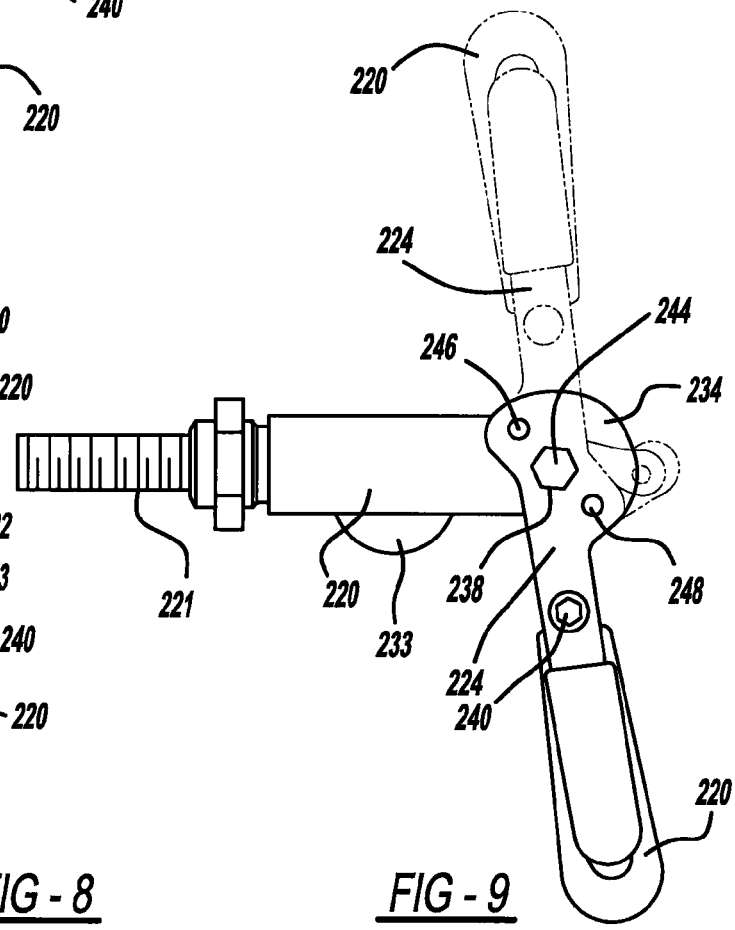
FIG. 9 shows a side view of a clamp in its fully clamped and fully unclamped position according to an alternate embodiment of the present invention.

FIGS. 7 through 9 shows yet another embodiment of the universal locking member 224 for use with a straight line action or plunger clamp 210. Like numerals indicate like parts. The plunger clamp 210 generally includes the same members as the clamps described above including a base member 212 having a handle member 220 pivotally connected thereto. Furthermore, a link member 233 is pivotally connected to the handle 220 and to a plunger 221 which is arranged within a bore of the base 212. The plunger 221 will slide with relation to the base 212 thus providing a straight line action mechanism for clamping doors, work pieces or the like. A locking lever 224, such as those described above for FIGS. 1 through 6, is connected at a fulcrum point through a fulcrum orifice 238 to a predetermined orifice through the handle 220 of the plunger clamp 210. The connection of the fulcrum orifice 238 of the locking lever 224 to the handle 220 will ensure that the locking lever 224 and handle 220 move in unison with relation to the base 212 of the clamp 210. A fastener 222 is passed through the base member 212 and the locking lever pivot orifice 244 to ensure that the locking lever 224 rotates with relation to the base member 212 as the handle 220 does. A locking pin 252 is arranged at a predetermined position in or through the base 212 of the plunger clamp 210. This will allow for a first and second locking orifice 246, 248 to be arranged at predetermined positions on a body 234 of the locking lever 224 to engage with the locking pin 252 of the plunger clamp 210 to lock the plunging clamp 210 in both its fully open and fully closed positions. The locking lever 224 operates the same way as described above, in that the lever 224 is urged by pushing on its angled arm 236 towards the handle 220 of the plunger clamp 210, thus releasing the body 234 of the locking lever 224 from the side surface of the base 212 and the first or second locking orifice 246, 248 of the locking lever 224 from the locking pin 252 thus creating rotation between the handle 220 of the plunger clamp 210 and the base 212 of the plunger clamp 210. This will allow for the clamp 210 to be either opened or closed into the two predetermined positions and positively locked therein via the first or second orifice 246, 248 of the locking lever 224. It should be noted that all of the components described for all three embodiments of the universal locking manual clamps are made of steel or any other metal, ceramic, plastic, composite except for the grips that are arranged over the ends of the handles and the arm of the locking lever which generally are made of a plastic or other soft rubber like material.

In operation, the user of any of the clamps described herein will move the clamp 10 from its open position as shown in FIGS. 2, 5 and 9 and move it into its fully closed or clamped position in the following manner. First, the operator will grasp the handle 20 and squeeze the arm 36 of the locking lever 24 towards the handle 20 thus disengaging the locking pin 52 from either the first or second locking orifice 46, 48 of the locking lever 24 and rotate the handle 20 and hence clamp 10 into its fully clamped or toggle position, thus engaging the first or second locking orifice 46, 48 depending on the design of the clamp 10 with the locking pin 52. This will lock the clamp 10 with a positive lock in its fully toggled position by engaging the locking pin 52 with the first or second locking orifice 46, 48 depending on the design requirements. Upon the need to unlock the clamp 10, the operator of the clamp 10 will squeeze the locking lever 24 towards the handle 20 of the clamp 10 and rotate the handle 20 and hence clamp 10 in the opposite direction, thus unlocking the clamp 10 and moving it into its fully unclamped position. In one contemplated embodiment the locking lever 24 will have a second locking orifice therethrough which will allow for the clamp 10 to be positively locked in its open position thus ensuring the clamp will not slip from its open position and harm the user of the clamp 10 or other materials around the manufacturing environment. However, it should be noted that it is contemplated to just use one locking orifice through the body of the locking lever 24 thus ensuring the clamp 10 is at least positively locked in its fully clamped or closed position. The locking lever 24 of the present invention as described herein is a universal locking mechanism that can be used on any variety of manual action locking clamps, such as those shown in FIGS. 1 through 9 or any other known manual locking or power clamp needing manual intervention to lock the clamp in either both or only one of a closed or open position.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A locking clamp, said clamp comprising:

a base;

a handle pivotally connected to said base and pivotal about a pivot axis;

a locking lever connected with said handle and pivotal about said pivot axis via a pivot orifice, said locking lever having a first locking orifice, a second locking orifice and a fulcrum orifice, said locking lever having a fulcrum defined at or near a bend therein, said fulcrum orifice passing through the locking lever and corresponding to an orifice through the handle;

a locking pin extending from a surface of said base, said locking lever locking said clamp in an open and closed position when said locking pin engages said first locking and second locking orifices of said locking lever; and wherein the locking lever is further connected to the handle via a fastener, said fulcrum orifice and said orifice through the handle.

2. The clamp of claim 1 further comprising a fastener arranged through said locking lever, said base and said handle, said fastener passes through said pivot orifice.

3. The clamp of claim 2 further comprising a spring arranged between said locking lever and a surface of said fastener.

4. The clamp of claim 1 further comprising a spacer arranged between said handle and said locking lever.

5. The clamp of claim 1 wherein the clamp is positively locked in a closed or clamped position wherein said locking pin is arranged in said first lock orifice and the clamp is positively locked in an open or unclamped position wherein said locking pin is arranged in said second lock orifice.

6. The clamp of claim 1 further comprising an arm pivotally connected to said base.

7. The clamp of claim 1 further comprising a plunger connected to said handle.

8. The clamp of claim 1 further comprising a grip over an end of said handle and a grip over an end of said locking lever.

* * * * *